US008297489B2

(12) United States Patent
Tsai

(10) Patent No.: US 8,297,489 B2
(45) Date of Patent: Oct. 30, 2012

(54) PACKAGING CONTAINER

(76) Inventor: Hsing Er Tsai, Kaohsiung (TW)

( * ) Notice: Subject to any disclaimer, the term of this patent is extended or adjusted under 35 U.S.C. 154(b) by 213 days.

(21) Appl. No.: 12/824,359

(22) Filed: Jun. 28, 2010

(65) Prior Publication Data

US 2010/0327048 A1 Dec. 30, 2010

(30) Foreign Application Priority Data

Jun. 29, 2009 (TW) ..... 98121896 A

(51) Int. Cl.
*B65D 5/355* (2006.01)
*B65D 17/28* (2006.01)

(52) U.S. Cl. ..... 229/101; 229/67.3; 229/150; 229/193; 229/223

(58) Field of Classification Search ..... 229/67.3, 229/101, 150, 193, 223
See application file for complete search history.

(56) References Cited

U.S. PATENT DOCUMENTS 899,212 A * 9/1908 Fiske ..... 229/193
1,940,849 A * 12/1933 Davidson ..... 229/223
2,389,580 A * 11/1945 Skell ..... 229/150
3,063,618 A * 11/1962 Berkowitz ..... 229/67.3
3,860,164 A * 1/1975 Dworkin ..... 229/67.3
4,008,650 A * 2/1977 Alter et al. ..... 229/67.3
4,441,648 A 4/1984 Portsmouth
5,566,827 A 10/1996 Janhonen
5,716,473 A * 2/1998 Gordon et al. ..... 229/193
6,019,279 A 2/2000 Tywoniuk
6,564,994 B2 * 5/2003 Makofsky et al. ..... 229/67.3
2004/0222281 A1 * 11/2004 Mangerson ..... 229/223

* cited by examiner

*Primary Examiner* — Gary Elkins
(74) *Attorney, Agent, or Firm* — Alan Kamrath; Kamrath IP Lawfirm, PA

(57) ABSTRACT

A packaging container includes a body plate defined into front and back faces by a first folding line. The front face includes second and third folding lines. The second and third folding lines define two connection portions. The body plate further includes an enclosing plate. A fourth folding line is located between the front face and the enclosing plate. The back face is folded upwards along the first folding line, and the connection portions are folded inwards along the second and third folding lines. The connection portions are stuck to the back face. A first pre-folding line and a second pre-folding line are located between the second and third folding lines. A fifth pre-folding line and a sixth pre-folding line are located on the back face. Two seventh pre-folding lines and two eighth pre-folding lines are defined.

9 Claims, 11 Drawing Sheets

PACKAGING CONTAINER

BACKGROUND OF THE INVENTION

1. Field of the Invention

The present invention generally relates to a packaging container and, more particularly, to a packaging container capable of accommodating not only a slab-like document stack but also a cubic article intended for express delivery.

2. Description of the Related Art

Referring to FIG. 1, a conventional packaging container 1 includes a front face 11, a back face 12 and a plurality of folding lines 2. A first folding line 21 is located between the front face 11 and the back face 12. The packaging container 1 further includes two side-enclosing portions 111 on two sides of the front face 11. A second folding line 22 is located between the front face 11 and one side-enclosing portion 111, and a third folding line 23 is located between the front face 11 and another side-enclosing portion 111. The packaging container 1 further includes a tongue plate 112 on another side thereof. A fourth folding line 24 is located between the front face 11 and the tongue plate 112. The tongue plate 112 includes a tear-off strip 113 and a pasting portion 114. The tear-off strip 113 includes two tearing lines 1131 on two sides thereof.

Referring to FIG. 2, during folding of the conventional packaging container 1, the side-enclosing portions 111 are folded inwards along the second folding line 22 and the third folding line 23 until the side-enclosing portions 111 lie on the front face 11. Then, each side-enclosing portion 111 is coated with an adhesive. Next, the back face 12 is folded upwards along the first folding line 21 until the back face 12 lies on the front face 11 and the side-enclosing portions 111. Through the adhesive, two sides of the back face 12 can be stuck to the side-enclosing portions 111, thus forming a bag. The packaging container 1 can now be used to accommodate documents or articles for delivery after folding the tongue plate 112 along the fourth folding line 24. When the tongue plate 112 is folded, the pasting portion 114 may be stuck to the back face 12 to enclose the packaging container 1. When a recipient receives the packaging container 1, the recipient may tear off the tear-off strip 113 along the tearing lines 1131 and take out the documents or articles contained in the packaging container 1.

However, the packaging container 1 is only suitable for accommodating paper documents or slab-like articles rather than cubic articles. To accommodate such a cubic article, a carton is required. Referring to FIG. 3, a cardboard may be folded according to a plurality of folding lines 31 to form a carton 3 having a receiving room 32. After an article is received in the receiving room 32, two side plates 33 are folded over the receiving room 32, and a top plate 34 is folded over to enclose the receiving room 32 while inserting a tongue plate 35 into the receiving room 32. Finally, each edge of the carton 3 is wrapped with tape to complete the packaging of the article.

Although the conventional carton 3 is able to accommodate a cubic article for delivery, two materials (cardboard and tape) are needed. As a result, cost is raised, and more storage space is required for accommodating the materials. Therefore, it is desired to improve the conventional packaging container.

SUMMARY OF THE INVENTION

The invention discloses a packaging container comprising a body plate defined into front and back faces by a first folding line. The front face includes second and third folding lines.

The second and third folding lines define two connection portions. The body plate further includes an enclosing plate. A fourth folding line is located between the front face and the enclosing plate. The back face is folded upwards along the first folding line, and the connection portions are folded inwards along the second and third folding lines. The connection portions are stuck to the back face. A first pre-folding line and a second pre-folding line are located between the second and third folding lines. A fifth pre-folding line and a sixth pre-folding line are located on the back face. Two seventh pre-folding lines are defined to connect a first end point of the first folding line to intersecting points where the first pre-folding line intersects the fourth and fifth pre-folding lines. Two eighth pre-folding lines are defined to connect a second end point of the first folding line to intersecting points where the second pre-folding line intersects the fourth and fifth pre-folding lines. Two opposing seams are defined on the first folding line.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
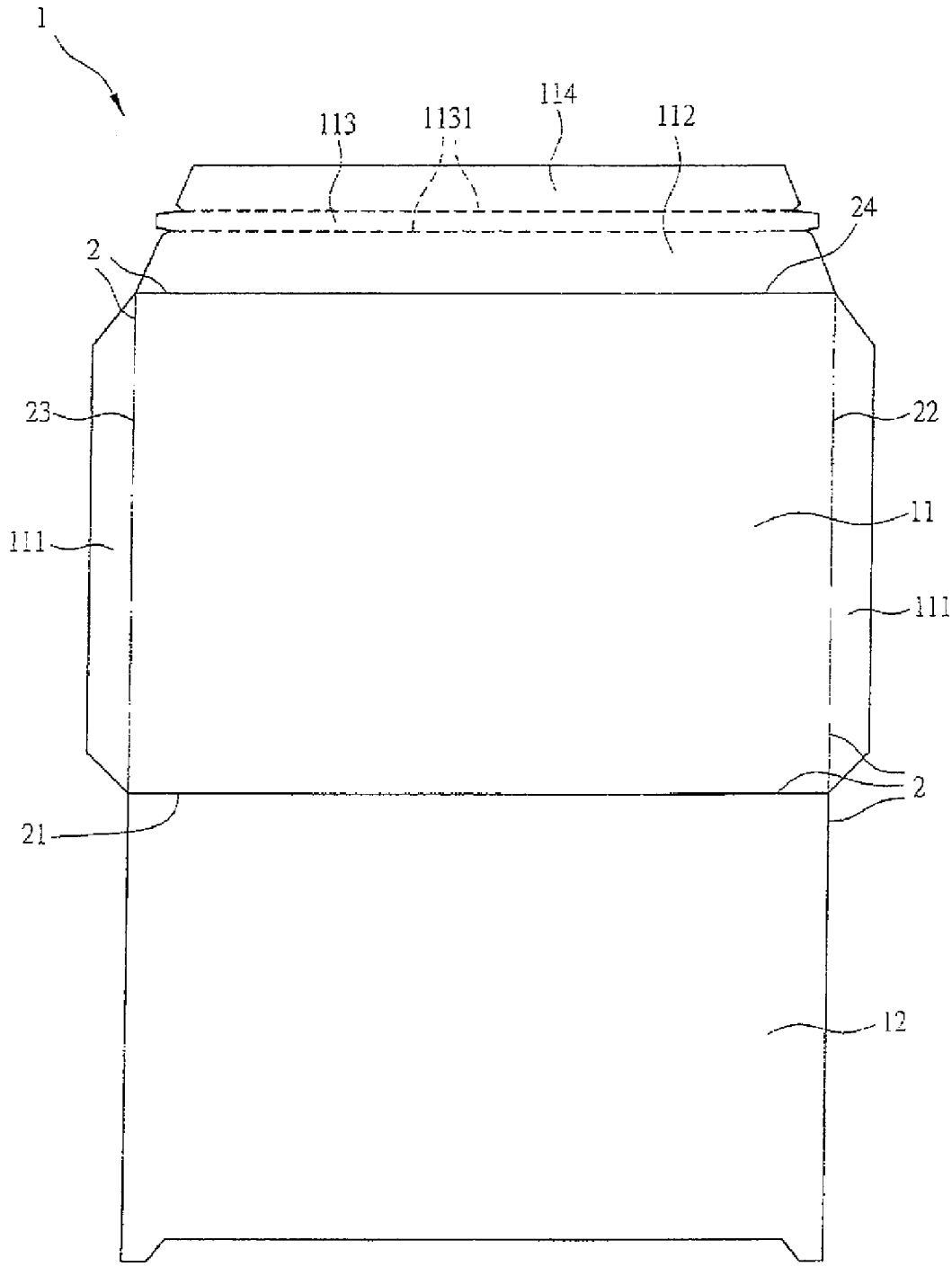
FIG. 1 PRIOR ART
FIG. 1 shows an expanded diagram of a conventional packaging container.
Figure 2:
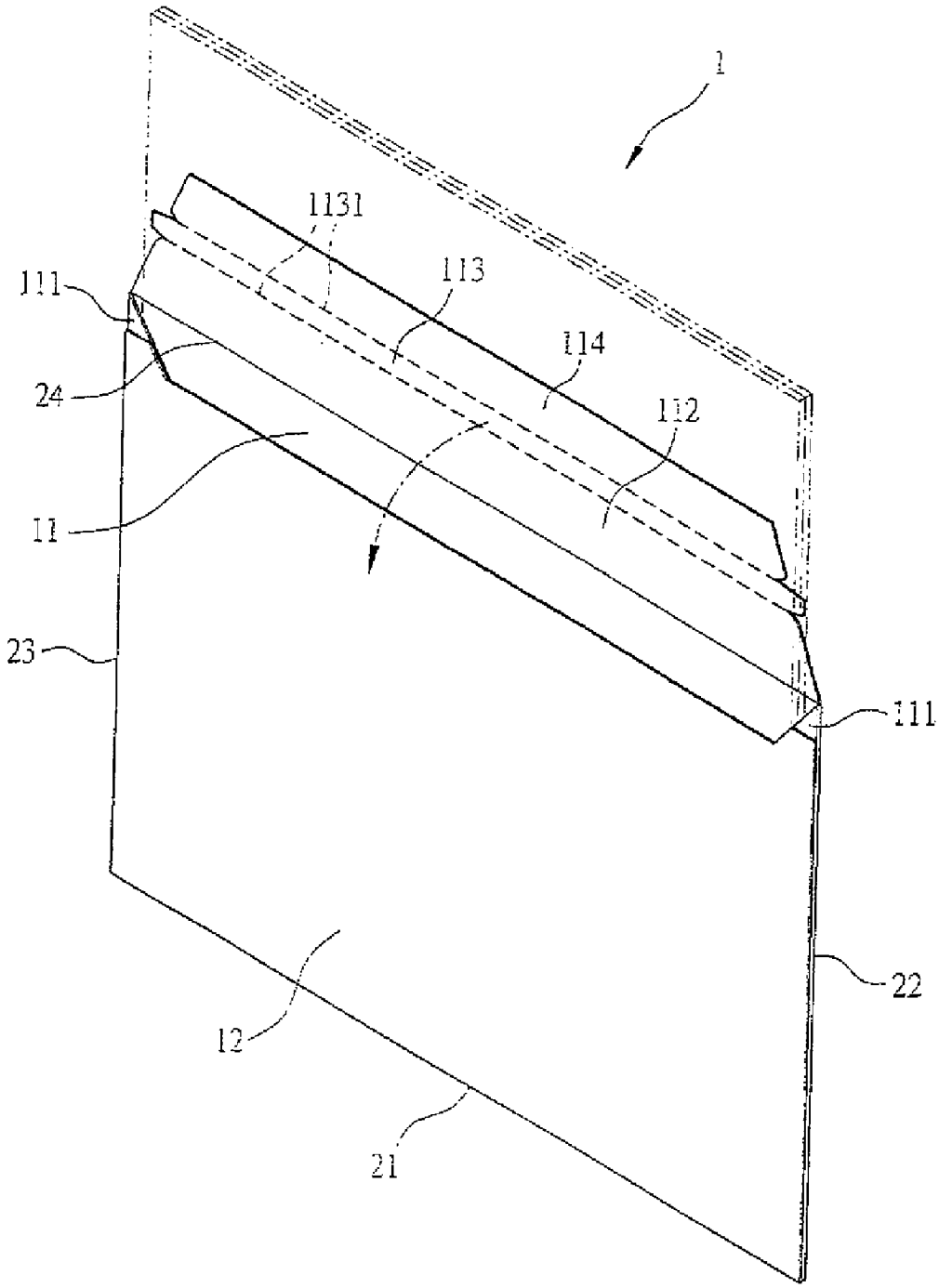
FIG. 2 PRIOR ART
FIG. 2 shows a three-dimension diagram of the conventional packaging container.
Figure 3:
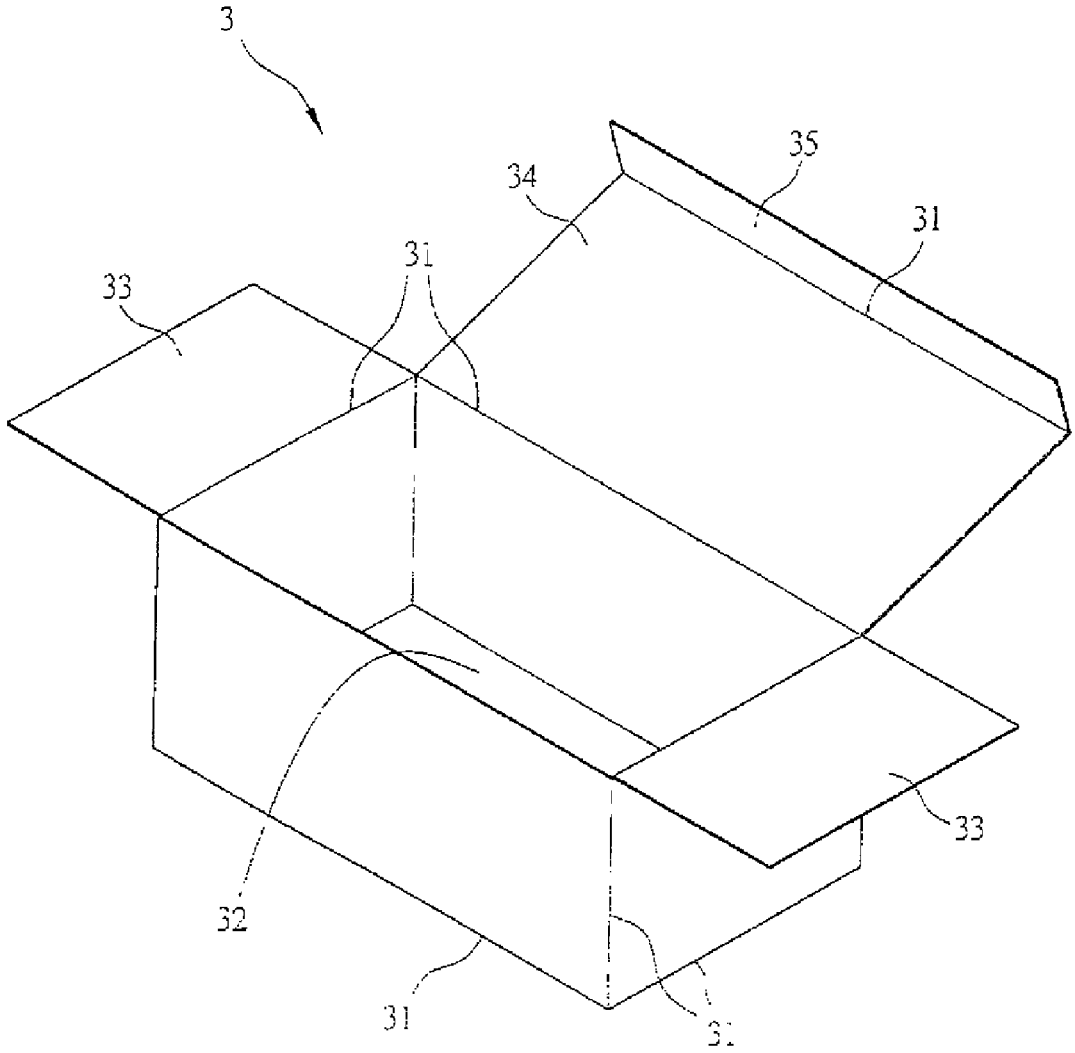
FIG. 3 PRIOR ART
FIG. 3 shows a three-dimension diagram of another conventional packaging container.

In the various figures of the drawings, the same numerals designate the same or similar parts. Furthermore, when the terms "first", "second", "third", "fourth", "inner", "outer", "top", "bottom" and similar terms are used hereinafter, it should be understood that these terms have reference only to the structure shown in the drawings as it would appear to a person viewing the drawings and are utilized only to facilitate describing the invention.

DETAILED DESCRIPTION OF THE INVENTION

Figure 4:
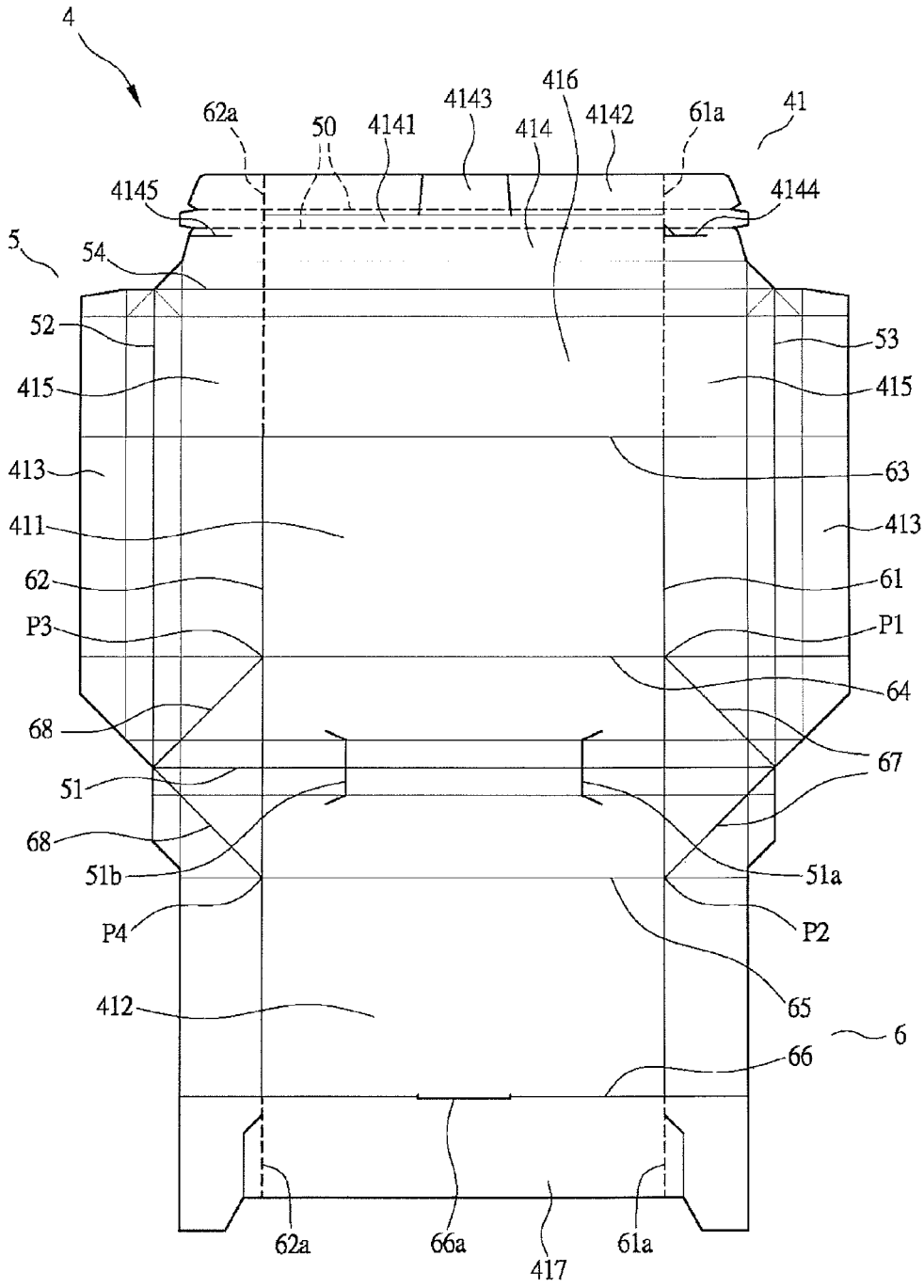
FIG. 4 shows an expanded diagram of a packaging container according to a preferred embodiment of the invention.

Referring to FIG. 4, a packaging container 4 is shown according to a preferred embodiment of the invention. The packaging container 4 includes a body plate 41 having a plurality of folding lines 5 and a plurality of pre-folding lines 6. The body plate 41 is defined into a front face 411 and a back face 412 by a first folding line 51. The front face 411 includes a second folding line 52 and a third folding line 53 on two sides thereof. The second folding line 52 defines a connection portion 413 on a side of the front face 411. The third folding line 53 defines another connection portion 413 on another side of the front face 411. The body plate 41 further includes an enclosing plate 414 on another side of the front face 411. A fourth folding line 54 is located between the front face 411 and the enclosing plate 414. The enclosing plate 414 includes a tear-off strip 4141 and a pasting portion 4142. The tear-off strip 4141 includes two tearing lines 50 on two sides thereof. The enclosing plate 414 further includes a tongue plate 4143 on which the pasting portion 4142 is located. The body plate 41 further includes two tearing lines 4144 and 4145 below the tear-off strip 4141.

A first pre-folding line 61 and a second pre-folding line 62 are located between the second folding line 52 and the third folding line 53 in parallel. The first pre-folding line 61 includes two tearing lines 61*a* on two ends thereof. The second pre-folding line 62 also includes two tearing lines 62*a* on two ends thereof. A third pre-folding line 63 and a fourth pre-folding line 64 are located on the front face 411 in a horizontal direction. A fifth pre-folding line 65 and a sixth pre-folding line 66 are located on the back face 412 in the horizontal direction. A seventh pre-folding line 67 is defined to connect a first end point (not numbered) of the first folding line 51 to an intersecting point P1 where the first pre-folding line 61 intersects the fourth pre-folding line 64. Another seventh pre-folding line 67 is defined to connect the first end point of the first folding line 51 to an intersecting point P2 where the first pre-folding line 61 intersects the fifth pre-folding line 65. An eighth pre-folding line 68 is defined to connect a second end point (not numbered) of the first folding line 51 to an intersecting point P3 where the second pre-folding line 62 intersects the fourth pre-folding line 64. Another eighth pre-folding line 68 is defined to connect the second end point of the first folding line 51 to an intersecting point P4 where the second pre-folding line 62 intersects the fifth pre-folding line 65. Two opposing seams 51*a* and 51*b* are defined on the first folding line 51 and arranged in a vertical direction. An inserting hole 66*a* is defined on the sixth pre-folding line 66.

Figure 5:
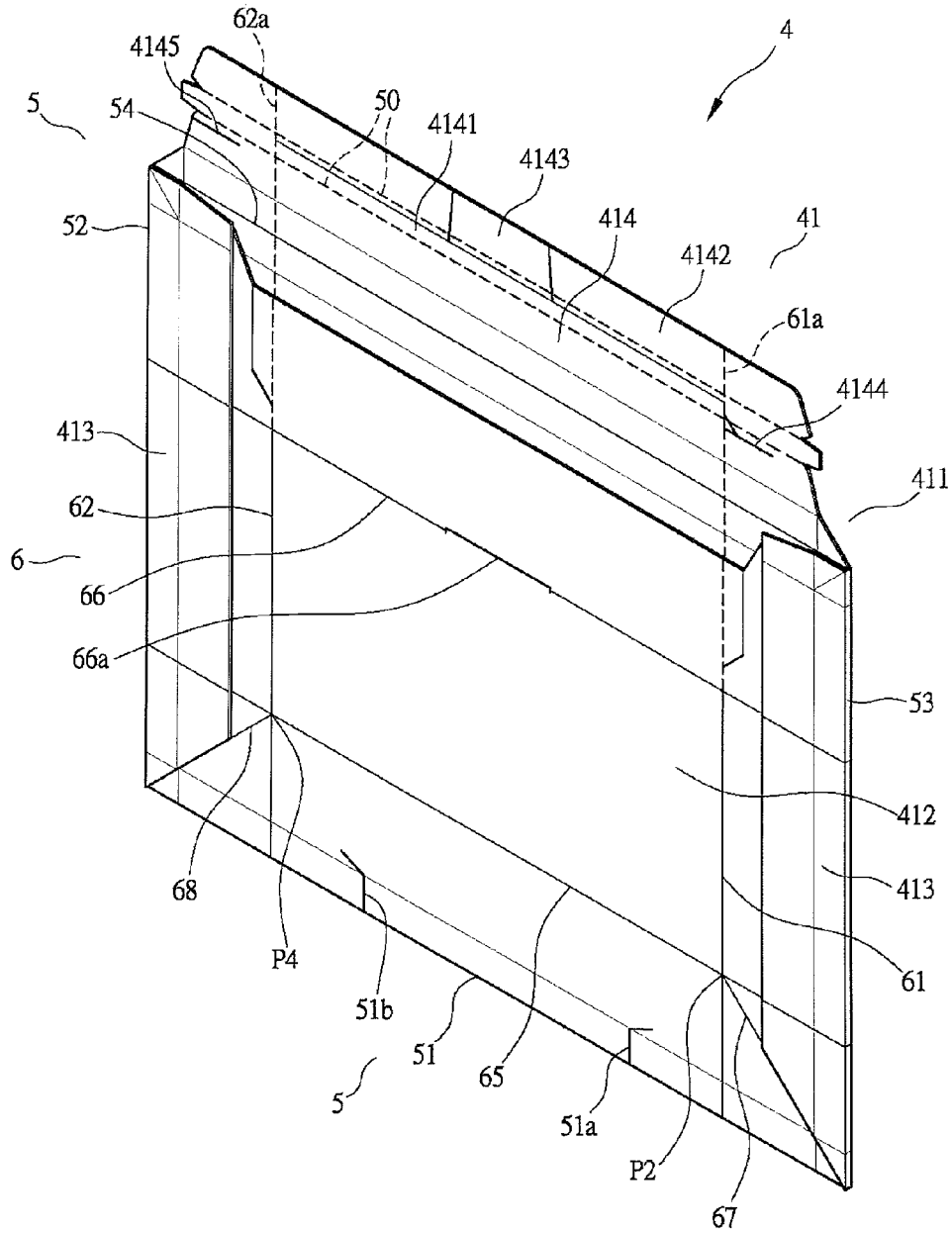
FIG. 5 shows a three-dimension diagram of the packaging container in an envelop-like form according to the preferred embodiment of the invention.

Referring to FIG. 5 also, when folding the packaging container 4, the back face 412 is folded upwards along the first folding line 51, and the connection portions 413 on two sides of the front face 411 are folded inwards along the second folding line 52 and the third folding line 53. Surfaces of the connection portions 413 are coated with an adhesive so that the connection portions 413 may be folded and stuck to the back face 412. Thus, an envelop-like bag is formed to accommodate a slab-like document or article. Finally, the enclosing plate 414 is folded downwards along the fourth folding line 54, and the pasting portion 4142 may be stuck to a surface of the back face 412 to enclose the bag.

Figure 6:
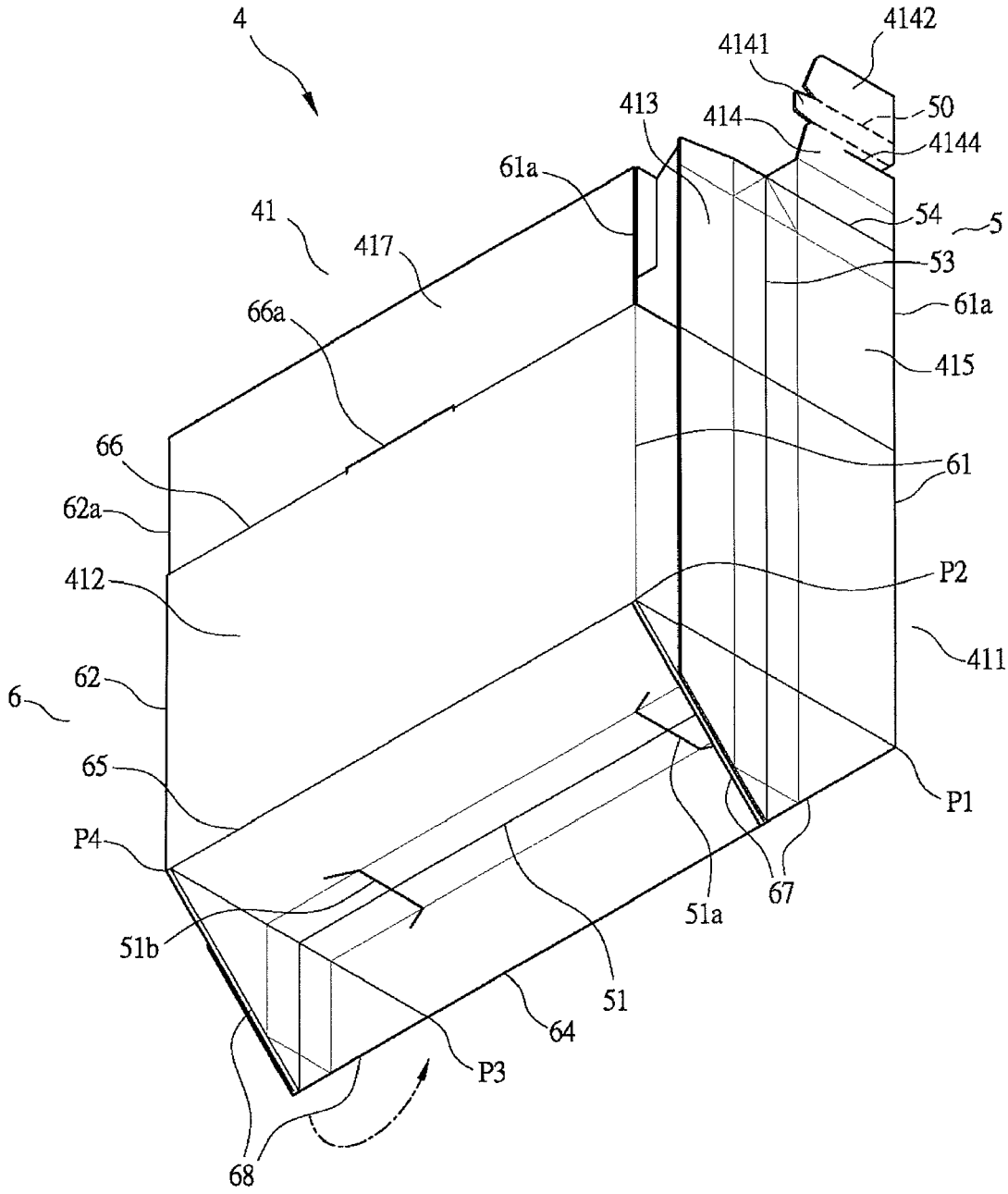
FIG. 6 shows a three-dimension diagram of the packaging container in a box-like form according to the preferred embodiment of the invention.
Figure 7:
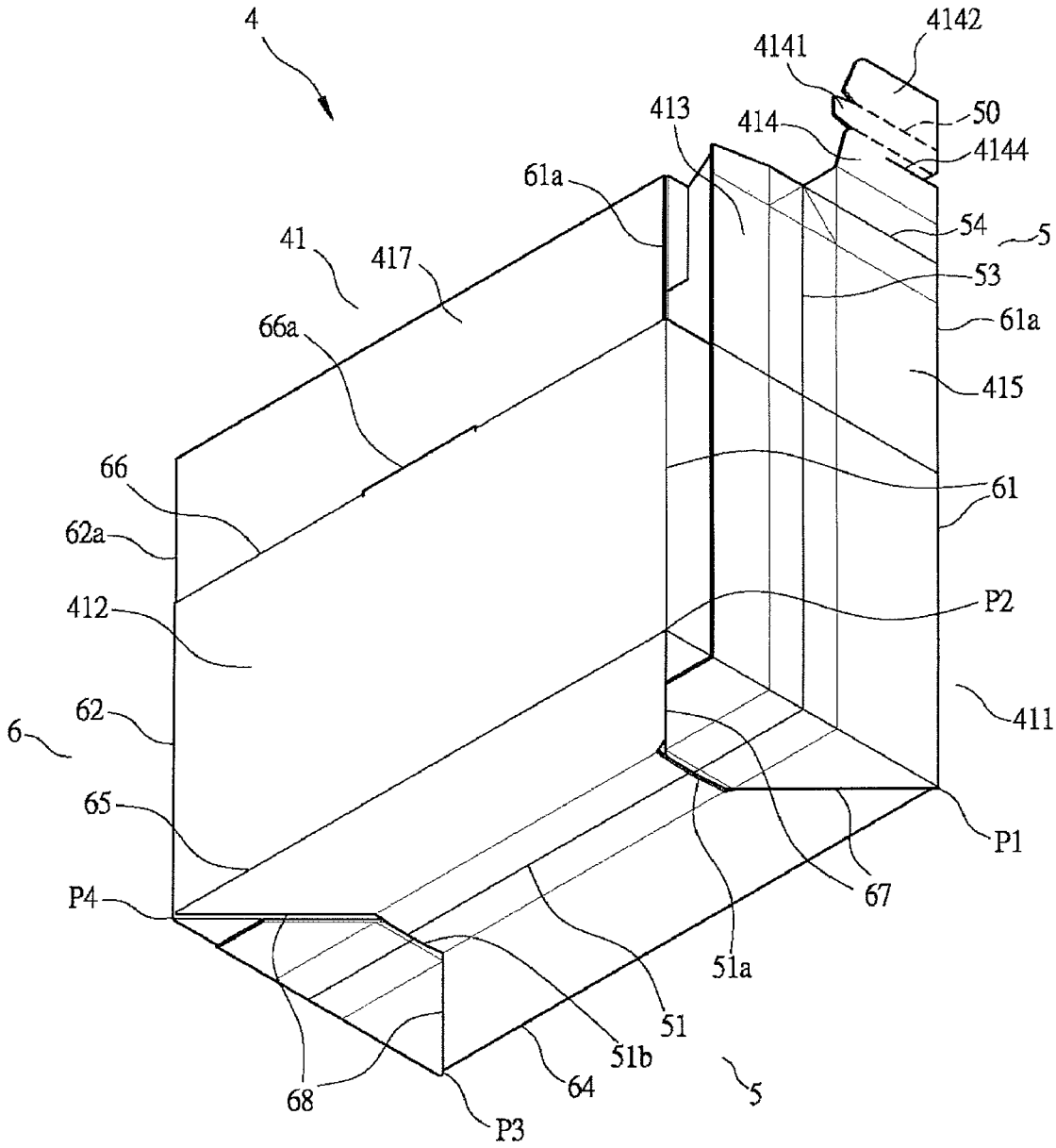
FIG. 7 shows another three-dimension diagram of the packaging container in the box-like form according to the preferred embodiment of the invention.
Figure 8:
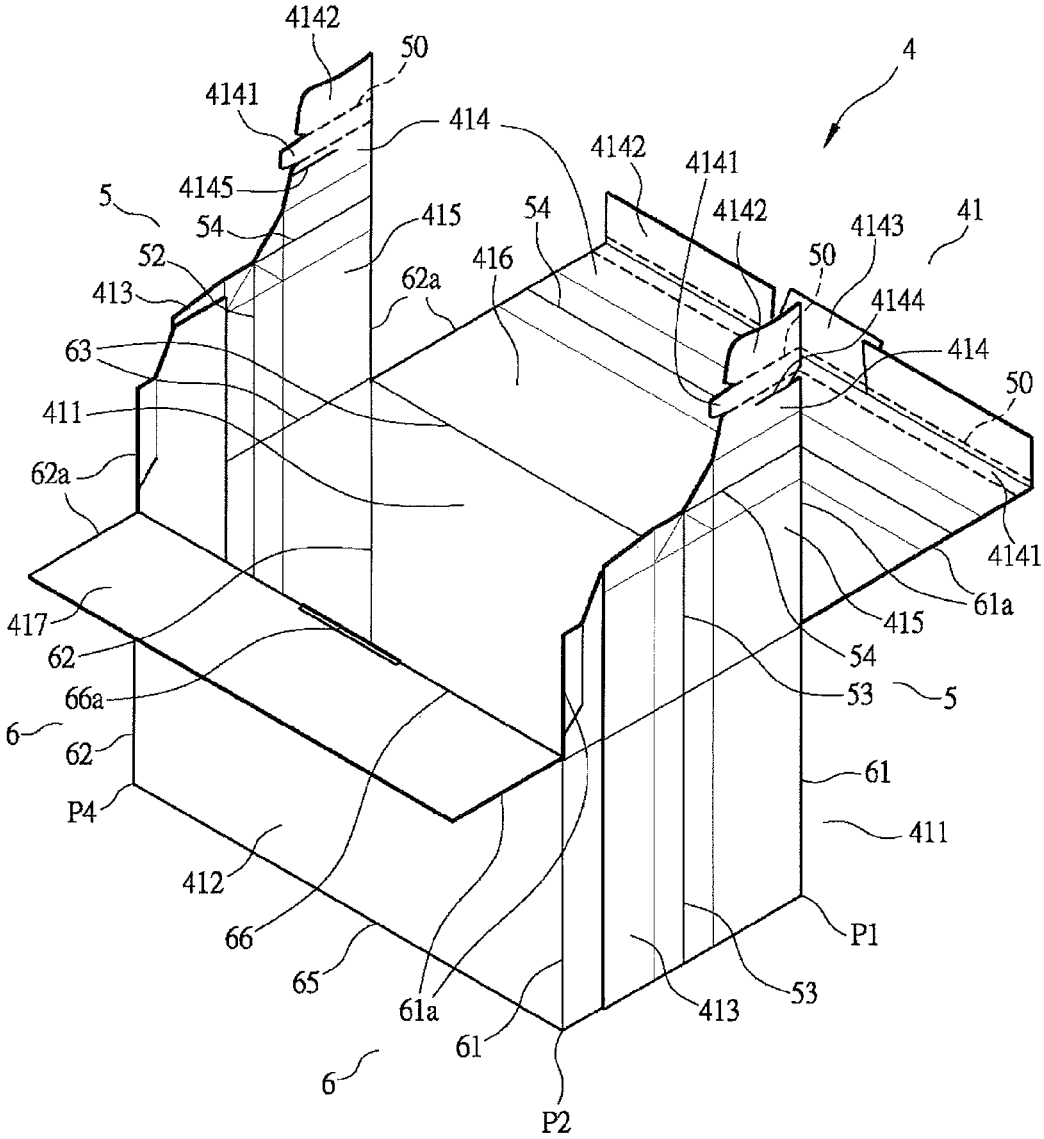
FIG. 8 shows a three-dimension diagram of the packaging container in the box-like form according to the preferred embodiment of the invention.
Figure 9:
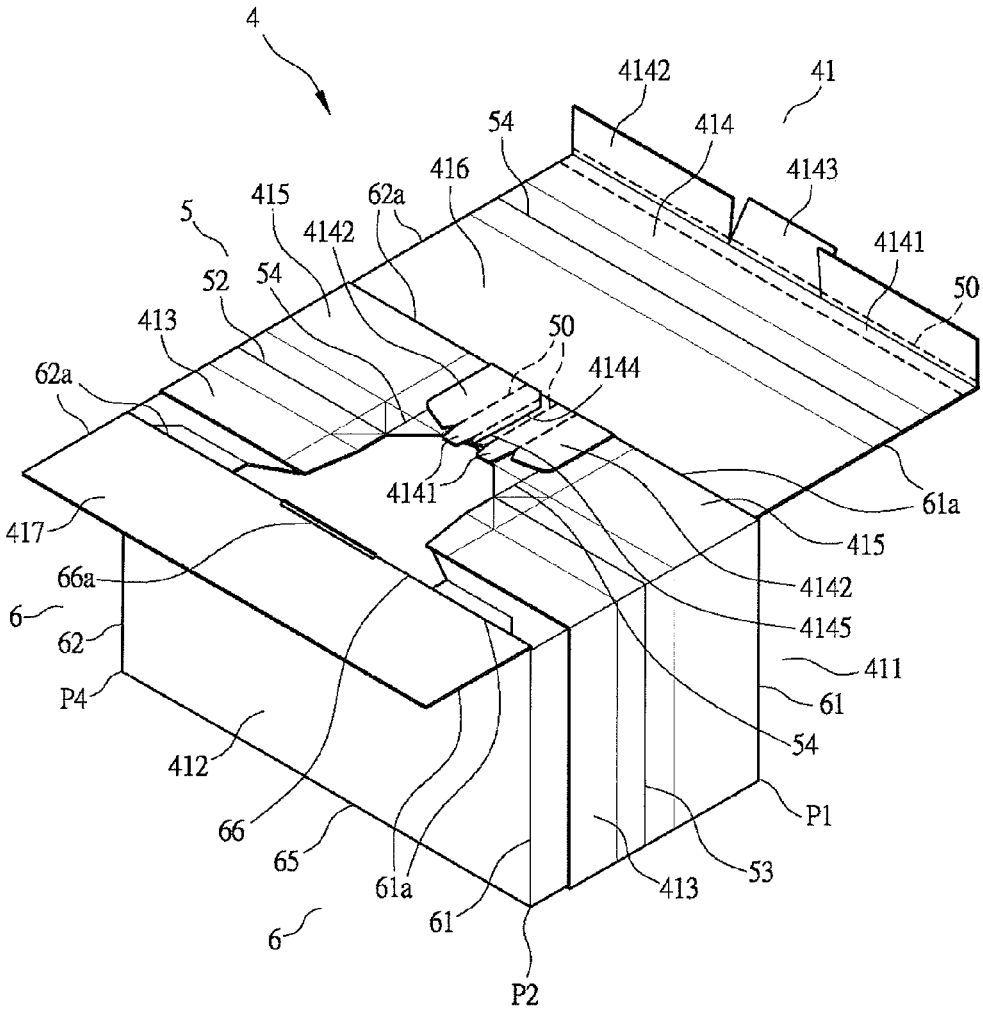
FIG. 9 shows a three-dimension diagram of the packaging container in the box-like form according to the preferred embodiment of the invention.
Figure 10:
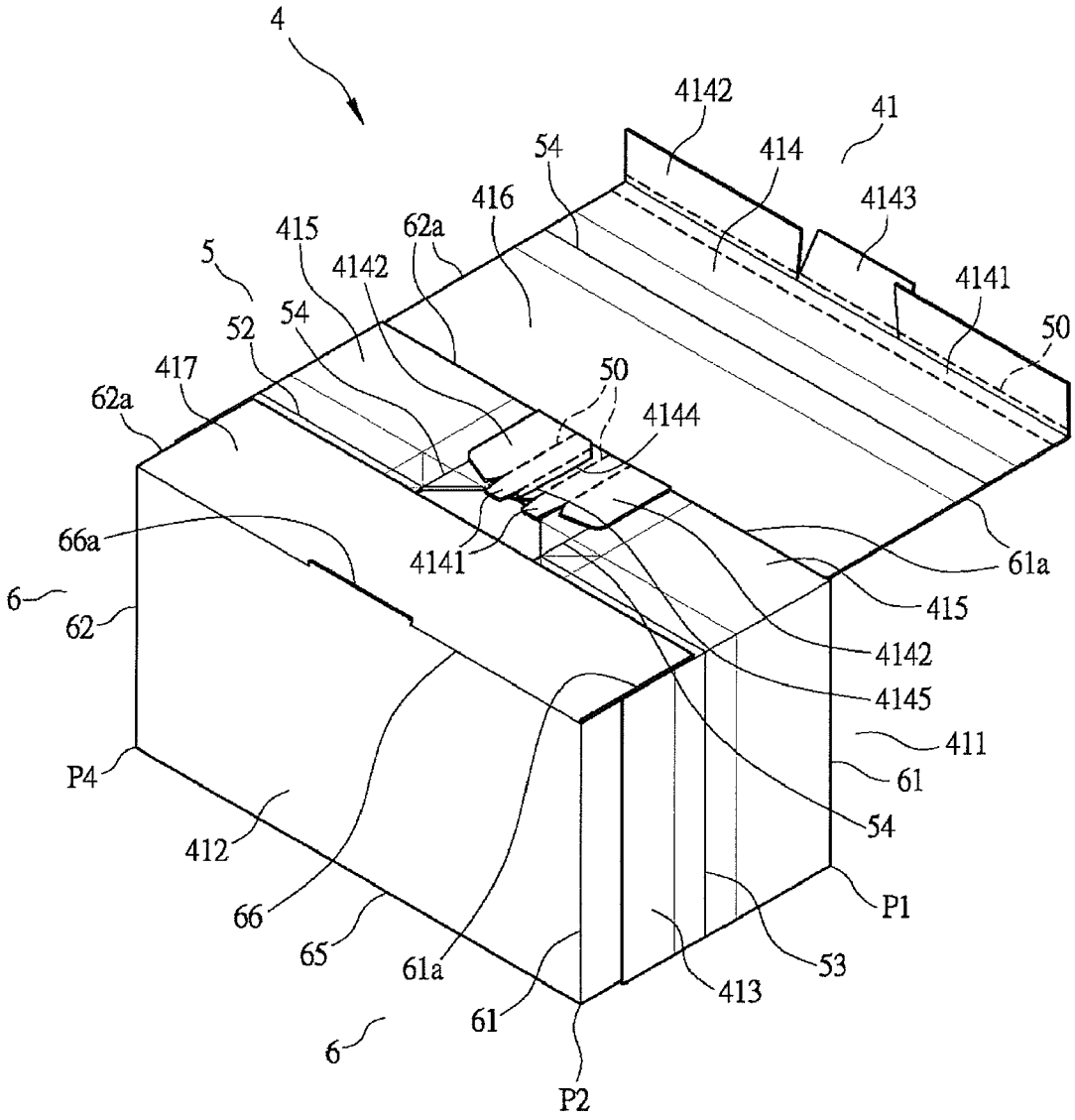
FIG. 10 shows a three-dimension diagram of the packaging container in the box-like form according to the preferred embodiment of the invention.
Figure 11:
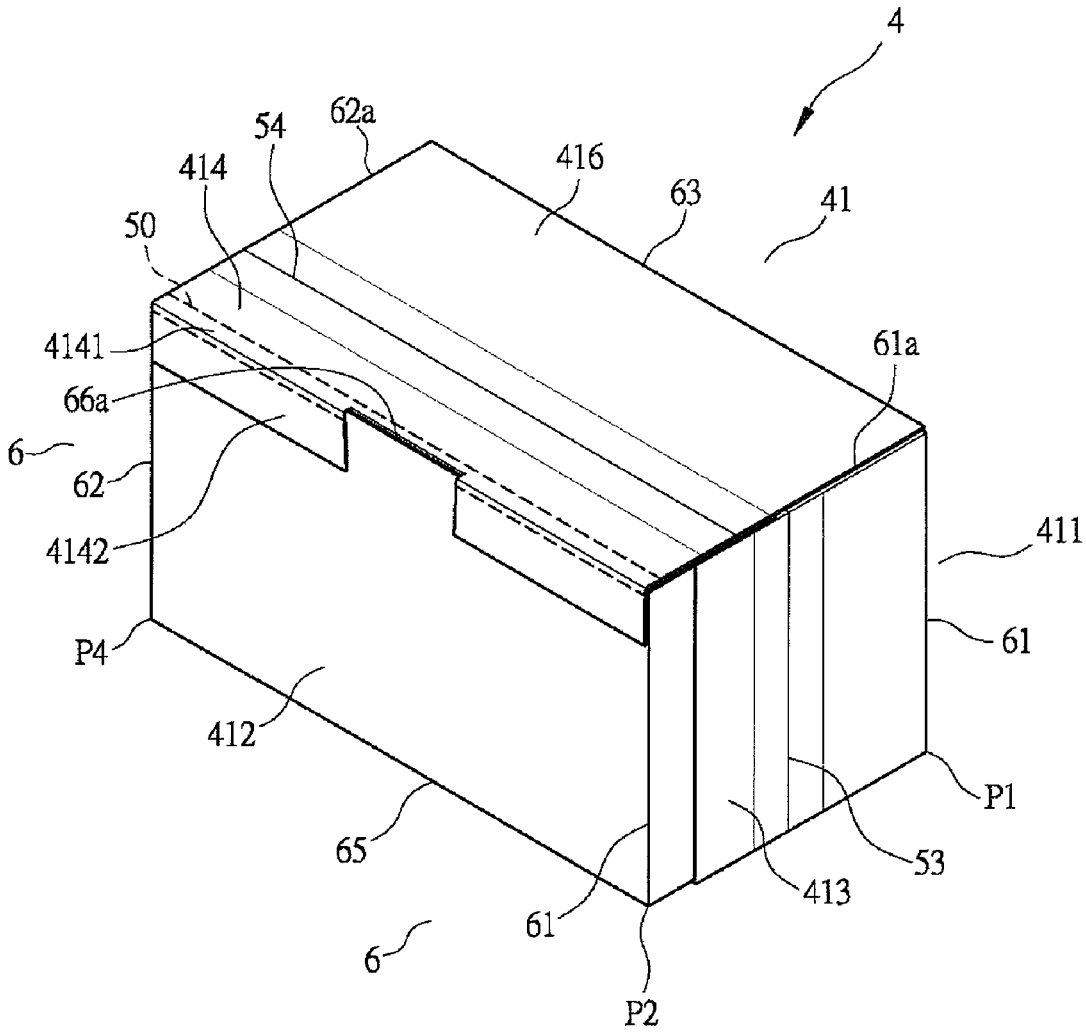
FIG. 11 shows a three-dimension diagram of the packaging container in the box-like form according to the preferred embodiment of the invention.

Referring to FIGS. 6 and 7 again, when a cubic article rather than a slab-like article is to be accommodated in the packaging container 4, the tearing lines 61*a* and 62*a* may be torn apart first. Then, the first folding line 51 is pushed and held upwards towards a direction perpendicular to the plane of the body plate 41, and the first pre-folding line 61 and the second pre-folding line 62 are pushed towards a center of the body plate 41, forcing the seventh pre-folding line 67 and the eighth pre-folding line 68 to form two triangle plates. Finally, the triangle plates are inserted into the seams 51 a and 51 b to form a box-like packaging container. 14

Referring to FIGS. 8 to 11, after the tearing lines 61*a* and 62*a* are torn apart, the third pre-folding line 63 and the tearing lines 61*a* and 62*a* may define two side plates 415 and a top plate 416. In addition, the sixth pre-folding line 66 and the tearing lines 61a and 62a may define an auxiliary plate 417. The inserting hole 66*a* is located on the sixth pre-folding line 66 as well as on an edge of the auxiliary plate 417. The side plates 415 may be folded over to cross together via the tearing lines 4144 and 4145. Then, the auxiliary plate 417 is folded over the side plates 415. Finally, the top plate 416 is folded over the auxiliary plate 417, and the tongue plate 4143 is inserted into the inserting hole 66a, thus enclosing the box.

In conclusion, based on the pre-folding lines 6, a box may be formed by pushing and holding the first folding line 51 upwards towards the direction perpendicular to the plane of the body plate 41, and pushing the first pre-folding line 61 and the second pre-folding line 62 towards the center of the body plate 41 to form two triangle plates to be inserted into the seams 51*a* and 51*b*. In this way, a cubic article is allowed to be accommodated in the box, thus achieving broader utility of the packaging container 4. Furthermore, the bottom of the packaging container 4 is integrally formed in one piece without using any tape or adhesive to combine two pieces of bottom plates. Therefore, the bottom of the packaging container 4 will have stronger support for articles carried. Moreover, the packaging container 4 can accommodate not only the slab-like articles but also cubic articles, reducing the use of other packaging containers. Thus, cost is further reduced.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A packaging container comprising:

a body plate defined into a front face and a back face by a first folding line, wherein the front face includes a second folding line and a third folding line on two sides thereof, wherein the second and third folding lines define two connection portions, wherein the body plate further includes an enclosing plate on another side of the front face, wherein a fourth folding line is located between the front face and the enclosing plate, wherein the back face is folded upwards along the first folding line, wherein the connection portions are folded inwards along the second folding line and the third folding line, wherein surfaces of the connection portions are coated with an adhesive and the connection portions are stuck to the back face, wherein a first pre-folding line and a second pre-folding line are located between the second folding line and the third folding line in parallel, wherein the first pre-folding line includes two tearing lines on two ends thereof, wherein the second pre-folding line includes two tearing lines on two ends thereof, wherein the enclosing plate has a first end and a second end, wherein the first and second prefolding lines are intermediate and spaced from the first and second ends of the enclosing plate, wherein a third pre-folding line and a fourth pre-folding line are located on the front face between the first and fourth folding lines in parallel, wherein the first pre-folding line is closer to the first end of the enclosing plate than the second pre-folding line is to the first end of the enclosing plate, wherein the first pre-folding line is spaced from the first end of the enclosing plate by a first distance, wherein the second pre-folding line is closer to the second end of the enclosing plate than the first pre-folding line is to the second end of the enclosing plate, wherein the second pre-folding line is spaced from the second end of the enclosing plate by a second distance, wherein a fifth pre-folding line and a sixth pre-folding line are located on the back face in parallel to the first folding line, wherein a seventh pre-folding line is defined to connect a first end point of the first folding line to an intersecting point where the first pre-folding line intersects the fourth pre-folding line, wherein another seventh pre-folding line is defined to connect the first end point of the first folding line to an intersecting point where the first pre-folding line intersects the fifth pre-folding line, wherein an eighth pre-folding line is defined to connect a second end point of the first folding line to an intersecting point where the second pre-folding line intersects the fourth pre-folding line, wherein another eighth pre-folding line is defined to connect the second end point of the first folding line to an intersecting point where the second pre-folding line intersects the fifth pre-folding line, and wherein two opposing seams are defined on the first folding line.

2. The packaging container as claimed in claim 1, wherein the enclosing plate includes a tear-off strip and a pasting portion.

3. The packaging container as claimed in claim 2, wherein the enclosing plate further includes a tongue plate on which the pasting portion is located.

4. The packaging container as claimed in claim 2, wherein the tear-off strip includes two tearing lines on two sides thereof.

5. The packaging container as claimed in claim 1, wherein the opposing seams are arranged in a vertical direction.

6. The packaging container as claimed in claim 1, wherein an inserting hole is defined on the sixth pre-folding line.

7. The packaging container as claimed in claim 4, wherein the third pre-folding line and the tearing lines of the first and second pre-folding lines jointly define two side plates and a top plate after the tearing lines of the first and second pre-folding lines are torn apart.

8. The packaging container as claimed in claim 1, wherein the sixth pre-folding line and the tearing lines of the first and second pre-folding lines jointly define an auxiliary plate.

9. The packaging container as claimed in claim 1, wherein the first distance is equal to the second distance.

* * * * *